United States Patent [19]

Dalton

[11] 4,181,077

[45] Jan. 1, 1980

[54] PREPARATION OF PRINTING SURFACES

[75] Inventor: Brian L. Dalton, London, England

[73] Assignee: Crosfield Exectronics Limited, London, England

[21] Appl. No.: 826,747

[22] Filed: Aug. 22, 1977

[30] Foreign Application Priority Data

Mar. 1, 1974 [GB] United Kingdom ..... 9442/74

[51] Int. Cl.[2] ..... B41C 1/04; B41N 3/02

[52] U.S. Cl. ..... 101/401.1; 101/426; 51/165.91; 51/165.77; 356/382; 324/61 R

[58] Field of Search ..... 101/400, 401, 401.1, 101/395, 150, 170, 426; 51/326, 327, 289 R, 165.91, 165.83, 165.77, 165.72, 103 R, 165 R, 103 WH; 324/61 QS, 61 R, 61 QL; 356/161

[56] References Cited

U.S. PATENT DOCUMENTS

| | | | |
|---|---|---|---|
| 3,172,208 | 3/1965 | Lowy | 235/103.5 R |
| 3,246,079 | 4/1966 | Teucher | 178/6.6 |
| 3,289,581 | 12/1966 | Roozee | 101/269 |
| 3,353,098 | 11/1967 | Foster et al. | 324/61 QS |
| 3,432,972 | 3/1969 | Snyder | 51/103 R |
| 3,455,239 | 7/1969 | Smith | 101/401.1 |
| 3,468,075 | 9/1969 | Armstrong | 51/254 |
| 3,568,372 | 3/1971 | Asano et al. | 51/165 R |
| 3,653,159 | 4/1972 | Ladewig | 51/5 B |
| 3,699,720 | 10/1972 | Lenning | 51/165.91 |
| 3,724,138 | 4/1973 | Ishikawa | 51/165 R |
| 3,732,648 | 5/1973 | Schaller | 51/103 R |
| 3,762,324 | 10/1973 | Ivary | 101/363 |
| 3,807,870 | 4/1974 | Kalman | 356/161 |
| 3,848,368 | 11/1974 | Toshioka et al. | 51/165 R |
| 3,848,369 | 11/1974 | Monajjem | 51/165.72 |
| 3,854,252 | 12/1974 | Lindsay et al. | 51/103 R |

FOREIGN PATENT DOCUMENTS

| | | | |
|---|---|---|---|
| 1229243 | 4/1971 | United Kingdom | 101/170 |

OTHER PUBLICATIONS

Donald, "Precavitated Rotogravure Plate . . ." RCA Technical Notes, TN#828, 4/69.

*Primary Examiner*—William Pieprz

*Attorney, Agent, or Firm*—Cushman, Darby & Cushman

[57] ABSTRACT

To make a gravure cylinder, a metal cylinder is formed with recesses in its surface in a regular pattern and all of substantially the same depth, the recesses constituting gravure cells separated by cell walls. A different material, generally a plastics material, is then used to overfill the cells and the filled cylinder is subjected to the action of a surfacing tool, the operation of which is controlled not with reference to the axis of the cylinder but with reference to the cylindrical surface formed by the tops of the metal cell walls.

10 Claims, 3 Drawing Figures

PREPARATION OF PRINTING SURFACES

This invention is concerned with the preparation of gravure printing surfaces. In our British Pat. specification No. 1,229,243, we have proposed a method of engraving a gravure printing surface in which the surface of a cylinder of a first material has formed therein cells which are of the maximum printing depth required and which are filled with a second material more easily decomposed or evaporated by a scanning laser beam than the material of the cylinder body. To engrave the cylinder, it is scanned with a laser beam, the energy of which is modulated in accordance with the image which it is desired to engrave, the intensity and scanning speed of the beam being so chosen that the first material is unaffected but the second material (the filling in the cell) is decomposed or evaporated to a depth depending on the beam energy of the scanning spot which falls upon it. The filling material may be a plastics material, e.g., an epoxy resin.

The advantage of such a method is that the laser beam does not have to be modulated in accordance with the cell pattern but only with the image to be recorded. Thus the scanning process does not have to be synchronised to the cell pattern. The initial steps of forming the surface to produce the cells can be carried out in advance, so that a number of the basic printing members, ready for engraving, can be prepared together and kept in stock.

The present invention is concerned with the initial steps of preparing the cylinder. When the cells formed in the first material are filled with the more easily decomposed or evaporated second material (usually a plastics material), it is almost certain that the cells will be overfilled, that is to say the cell filling material will project beyond the cylinder surface and will extend over substantially the whole surface of the cylinder. This surplus material must be removed so that the surface of the filling material in each cell is substantially flush with the surrounding surface of the cylinder. This presents some difficulty.

According to the present invention, a gravure cylinder, for use in a gravure printing process, is made by forming a cylinder having a surface of a first material with recesses in a regular pattern and all of substantially the same depth, the recesses constituting gravure cells separated by cell walls, filling the recesses with a second material more easily removed than the metallic surface by a scanning energy beam, and subjecting the filled cylinder to a surfacing operation in which the cylindrical surface of the first material formed by the tops of the cell walls is itself used as a reference to control the thickness of the surface layer to be removed at any point. As an example, the cylinder may be surfaced by honing, controlling the pressure of the honing head on the surface by detectors which sense the distance to the surface, so that the pressure approaches zero when all the excess material has been removed from the surface. Alternatively, a turning operation can be employed with the thrust pad controlling the height of the turning tool relative to the metallic surface of the cylinder. In some cases, a grinding operation can be used.

The cells may be recesses formed in the metal surface of the cylinder body or the cells may be formed by making recesses or holes in a thin metal sheet and placing this round the body of a cylinder.

The difficulties with earlier attempts to remove the excess plastics material from the cylinder surface arose from the fact that the cell depth is of the same order of magnitude as the eccentricity which is normally encountered in the mounting of a cylinder on a shaft. Consequently the surface accuracy must be considerably less than the eccentricity. As an example, the eccentricity may amount to 1/1,000th of an inch and the amount of surface material to be removed may be only two or three times this amount. As a consequence, in some places more material was removed from the surface than in other places, with the result that filled cells of different depths were produced.

In order that the invention may be better understood, two methods embodying the invention will now be described with reference to the accompanying drawings, in which.

Figure 1:
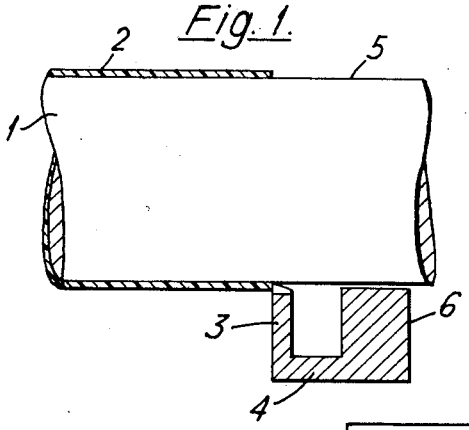
FIG. 1 shows diagrammatically a turning operation for surfacing a gravure cylinder.

In FIG. 1, a cylinder 1 is formed with recesses (not shown) in a regular pattern and of a uniform depth. These recesses have been filled with a plastics material which has been used in excess, so that a plastics coating 2 has been left on the surface of the cylinder. This coating is removed by a diamond tool 3 attached to a carriage 4 which is located with respect to the already clean surface of the cylinder 5 by a bearing 6. If the cylinder is eccentric, as it rotates the eccentricity is transferred through the bearing 6 to the diamond carriage so that the tool will follow the surface. In the preferred method, the bearing is a hydro-static bearing using water as a lubricant; alternatively oil may be used. Instead of a hydro-static bearing, a plastic bearing surface (for example, PTFE) or a composite bearing surface (for example phosphor-bronze loaded with PTFE) may be used.

To allow for diamond wear, temperature distortion of the carriage, and so on, and thereby to ensure the correct depth of cut, the distance of reference points on the carriage to the pre-cut and post-cut cylinder are measured. The distance of the carriage from the pre-cut surface may be measured through the plastics film inductively or by measurement of the resistance or capacitance of the plastics film. The distance of the carriage from the post-cut surface may be used to restrict the amount of metal cell-wall material which is removed to the minimum, as it is desirable that the metal cylinder should be capable of re-use by refilling the cells, resurfacing and re-engraving. The two measurements permit the position of the diamond head to be altered with respect to the bearing surface to compensate for errors in the system.

Figure 2:
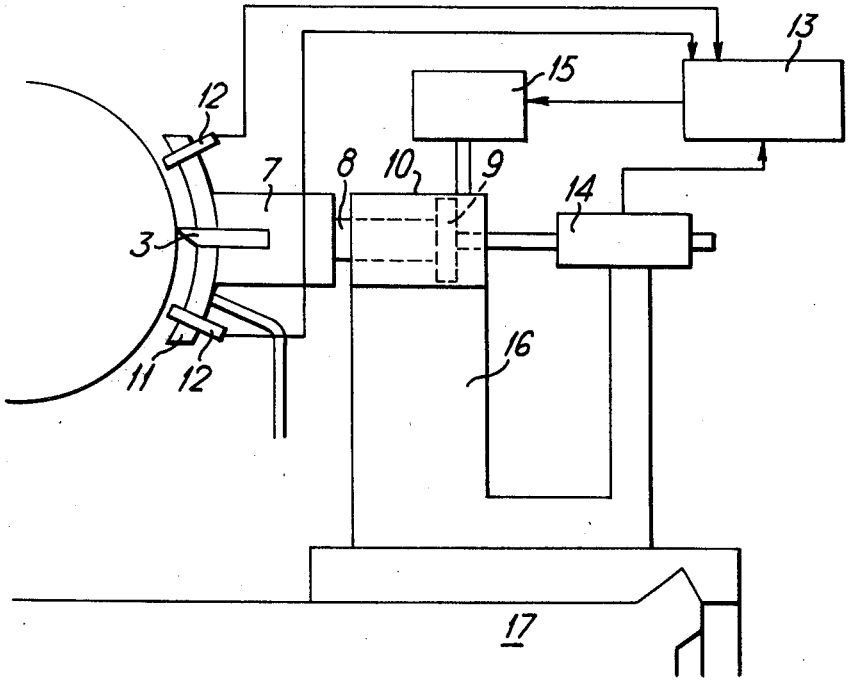
FIG. 2 illustrates in greater detail the apparatus used in the turning operation.

Apparatus for carrying out such a turning operation is shown in FIG. 2 of the accompanying drawings. In FIG. 2, the diamond cutting tool 3 is mounted in an adjustable holder 7 attached to an actuator shaft 8 of a piston 9 in a hydraulic thruster cylinder 10.

A thrust plate 11, containing force-feed hydraulic outlets, carries sensing elements 12, one of which senses the distance to the cylinder surface after curring and the other of which senses the distance to the cylinder surface before cutting. The outputs of sensing elements 12 are applied to an electronic processor 13 which measures their difference and which also receives a signal from an electrical device 14 for sensing the position of the piston in the cylinder 10. The electronic processor 13 provides a signal representing the required position of the piston and applies this signal to an electrically driven hydraulic supply 15 for the cylinder.

The elements described are mounted on a main frame 16 which in turn is mounted for sliding motion on a bed plate 17.

In this way, the height of the turning tool relative to the cylinder surface is controlled.

Suitable sensing systems for the device shown in FIG. 2 are capacitative and inductive measuring techniques and techniques based on the absorption of infrared radiation by the plastics material. Typically, the pitch of the cut may be 50 microns and the depth of the cut 10 microns. The speed of rotation may be from 300 to 1,000 r.p.m.

To provide a reference surface at the start of the operation, it can be arranged that the metal cylinder edges are not coated with the filler material (cells are not engraved at the cylinder edges); alternatively, coating material at the edges of the cylinder may be removed by dissolving the plastics material in a suitable etchant.

Figure 3:
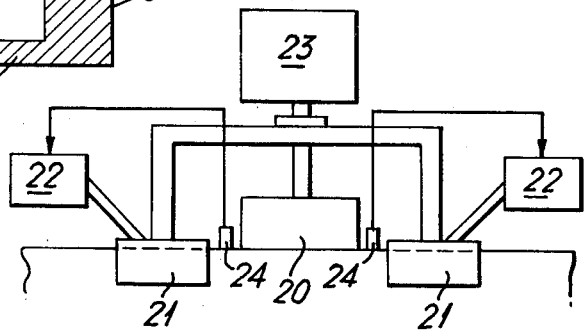
FIG. 3 illustrates a honing operation for surfacing the cylinder.

In FIG. 3, the turning process is replaced by a honing process. The honing process is particularly suitable when the plastics material includes a hardening additive, since it is less likely to leave soft material embedded in the surface of a hardened plastics material.

As an example, an epoxy plastics material may include a hardening additive in the form of particles of sub-micron size. Suitable hardening additives are aluminium oxide (corundum) in the proportion of 40%–60% by weight; titanium dioxide in the proportion of 10%–40% by weight; and carbon black in the proportion of 2%–25% by weight.

It would be possible to control the pressure applied to the honing tool in a manner somewhat similar to the depth-of-cut control in FIG. 1. However, as most printers already have a suitable spring-loaded honing head, we have illustrated in FIG. 3 a modified form of such apparatus in which the spring-loaded honing head is lifted off the surface to a greater or lesser extent, according to the depth of plastics material to be removed.

In FIG. 3, the honing tool 20 on a shaft extending from a spring-loaded pressure head 23 is surfacing a cylinder 25. Two thrust heads 21 are fixed to the shaft and are located one on each side of the honing head. Sensors 24 detect the amount of plastics material remaining on the cylinder and their output signals are applied to hydraulic controllers 22 which supply water to the thrust pads 21. The control is such that the smaller the amount of plastics material to be removed, the greater the amount by which the thrust pads are lifted from the surface of the cylinder, and as a consequence the greater is the reduction in the pressure applied to the honing head. The pressure approaches zero when all the excess plastics material has been removed. The honer may rotate about a fixed axis as the cylinder rotates or the honer may move bodily over the cylinder surface; for example, it may have an orbiting motion on which is superimposed a more rapid circular bodily movement of the honer, in which case the honer need not rotate about its own axis.

When a honing technique is used, as the thickness of the plastics coating is reducing by honing the cell walls become visible, due to the limited absorption of the plastics material at optical wavelengths. Thus, for honing, the sensors 24 can measure the distance from the surface by an optical technique, namely by shining a light beam at the surface and monitoring the reflectance from the metal surface, the resulting signal being used as the feedback parameter.

Typically, the rotational speed of the honing wheel may be 300 r.p.m. and that of the cylinder 100 r.p.m. A very fine grit size is used for the final stage of honing.

In some cases, it may be desirable to remove the surplus material from the cylinder surface in two stages. In such cases, carborundum may be used in a first coarse stage and a diamond tool for the second fine stage of removal of the excess material.

An advantage of cylinders with pre-filled holes or recesses is that the holes can be made and filled in an operation separate from the image-producing operation, so that a batch of cylinders can be prepared in advance and stored; this means that no etching or perforating operation has to be carried out at the time of the preparation of the image. However, it is desirable to leave the above-described surface preparation until after storage, so that any minor scratches occuring during transit and storage will be eliminated with the removal of the surplus material.

In one particularly advantageous form, a turning tool is mounted on the same machine as the image-reproducing head, in advance of the reproducing head. With this arrangement, the surfacing operation is carried out in image-production time ahead of the engraving tool.

Although the invention has been described with reference to a cylinder in which the cells are filled with plastics material, it could also be used for surfacing cylinders having fillers of other materials; for example, the filler could be of a metal softer than the metal of the body of the cylinder, for use when the subsequent scanning operation was performed by an electron beam.

I claim:

1. A method of making a gravure cylinder, for use in a gravure printing process, comprising the steps of:

forming a cylinder having a surface of a first material with recesses in a regular pattern and all of substantially the same depth, the recesses constituting gravure cells separated by cell walls;

filling the recesses with a second material in liquid form and allowing the said second material to solidify, the solidified material being more easily removed than the first material by a scanning energy beam, the second material being used in excess of that required to fill the recesses; and thereafter subjecting the surface of the filled cylinder to an abrading operation to remove a surface layer of the filled cylinder;

sensing the cylindrical surface of the first material formed by the tops of the cell walls at a point closely adjacent to the point from which removal of the surface layer is to take place; and using, as a reference to control the thickness of the surface layer to be removed at any point said cylindrical surface of the first material formed by said tops of the cell walls.

2. A method in accordance with claim 1, in which the abrading operation is a honing operation in which a thrust pad abutting the cylinder controls the pressure of the honing head on the surface so that the thrust approaches zero when all the excess material has been removed.

3. A method in accordance with claim 1, in which the surface of the cylinder is metal and the abrading operation is a turning operation in which a thrust pad adjacent the cylinder controls the distance of the turning tool from the metal surface of the cylinder in which the recesses are formed.

4. A method in accordance with claim 1, in which the surface of the cylinder is metallic, in which the filler material is a plastics material so that a coating of plastics material has to be removed from the metallic surface in which the recesses are formed, and in which the thickness of the said coating to be removed from the metallic surface is measured electrically.

5. A method in accordance with claim 1, in which the filler material is a plastics material.

6. A method in accordance with claim 4, wherein said step of sensing includes measuring the distance of a carriage supporting an abrading tool from the metallic surface of a portion from which the surface layer has been removed, and measuring the distance of the carriage supporting the abrading tool from an underlying portion of the cylindrical surface which has not yet been removed, and said step of using includes comparing the two distances, and using the difference to control the extent to which the abrading tool removes surface material from the cylinder.

7. A method in accordance with claim 5, in which the surface of the cylinder is metallic and said step of sensing includes measuring the thickness of the plastics coating on the cylinder by the amount of incident light which is reflected through the plastics coating from the underlying metallic surface.

8. A method in accordance with claim 1, in which the recesses in the cylindrical surface are formed by making recesses or holes in a thin metal sheet and placing this sheet around a cylindrical core.

9. A method in accordance with claim 1, in which the surfacing of the cylinder is carried out in the same operation as but in advance of an image reproducing process in which plastics material is excavated from the said recesses in accordance with the density value of a required image at that point.

10. A method as in claim 1, wherein said abrading is grinding.

* * * * *